343-700 MS AU 251 EX
5/7/85 XR 4,516,097

United States Patent [19]

Munson et al.

[11] Patent Number: 4,516,097

[45] Date of Patent: May 7, 1985

[54] APPARATUS AND METHOD FOR COUPLING R.F. ENERGY THROUGH A MECHANICALLY ROTATABLE JOINT

[75] Inventors: Robert E. Munson; Hussain A. Haddad, both of Boulder, Colo.

[73] Assignee: Ball Corporation, Muncie, Ind.

[21] Appl. No.: 404,655

[22] Filed: Aug. 3, 1982

[51] Int. Cl.[3] ..... H01P 1/06; H01Q 1/38

[52] U.S. Cl. ..... 333/261; 343/700 MS; 343/763

[58] Field of Search ..... 343/700 MS, 762, 763, 343/757, 758; 333/261, 256, 257, 261

[56] References Cited

U.S. PATENT DOCUMENTS

| | | | |
|---|---|---|---|
| Re. 29,296 | 7/1977 | Krutsinger et al. | 343/700 MS |
| 2,401,572 | 6/1946 | Korman | 333/261 |
| 2,426,226 | 8/1947 | Labin et al. | 333/261 |
| 2,805,414 | 9/1957 | Taylor | 343/761 |
| 3,546,699 | 12/1970 | Smith | 343/762 |
| 3,713,162 | 1/1973 | Munson et al. | 343/705 |
| 3,771,075 | 11/1973 | Phelan | 333/238 |
| 3,786,376 | 1/1974 | Munson et al. | 333/261 |
| 3,810,183 | 5/1974 | Krutsinger et al. | 343/708 |
| 3,914,715 | 10/1975 | Hubing et al. | 333/24 R |
| 4,150,345 | 4/1979 | Goldman et al. | 333/116 |
| 4,157,516 | 6/1979 | Vandegriip | 333/26 |
| 4,163,961 | 8/1979 | Woodward | 333/261 |
| 4,233,580 | 11/1980 | Treczka et al. | 333/261 |
| 4,253,101 | 2/1981 | Parr | 343/763 |
| 4,258,365 | 3/1981 | Hockham et al. | 343/763 |
| 4,288,759 | 9/1981 | Stover | 333/24 R |
| 4,358,746 | 11/1982 | Miller et al. | 333/261 |

*Primary Examiner*—Eli Lieberman
*Attorney, Agent, or Firm*—Gilbert E. Alberding

[57] ABSTRACT

First and second annular r.f. radiating structures are mounted for concentric relative rotational motion with their r.f. radiation patterns directed toward one another. The annular r.f. radiating structures may be realized, for example, by cylindrically conformed microstrip antenna radiators which define tuned resonant cavities feeding one or more radiation apertures defined between an edge of a microstrip radiator "patch" and an underlying electrical reference or ground surface. The microstrip radiator "patch" may be either continuous in its circumferential dimensions or it may have occasional circumferential discontinuities formed by axially directed gaps therein. If the total circumferential dimension is greater than one wavelength at the intended operating frequency, then a corporate structured feedline provides plural spaced-apart feedpoints about the circumference so as to achieve a substantially uniform distribution of r.f. field amplitudes and phases about the circumference.

31 Claims, 7 Drawing Figures

Figure 5:
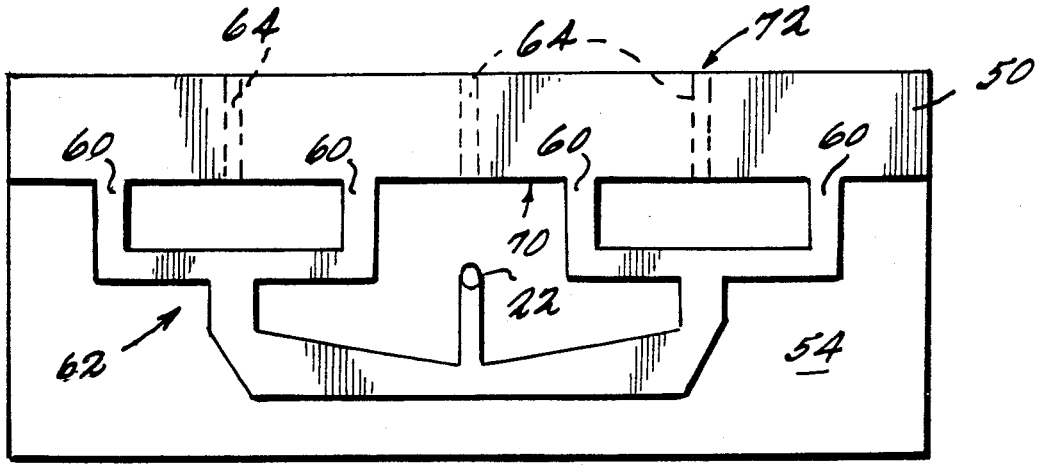

FIG. 1
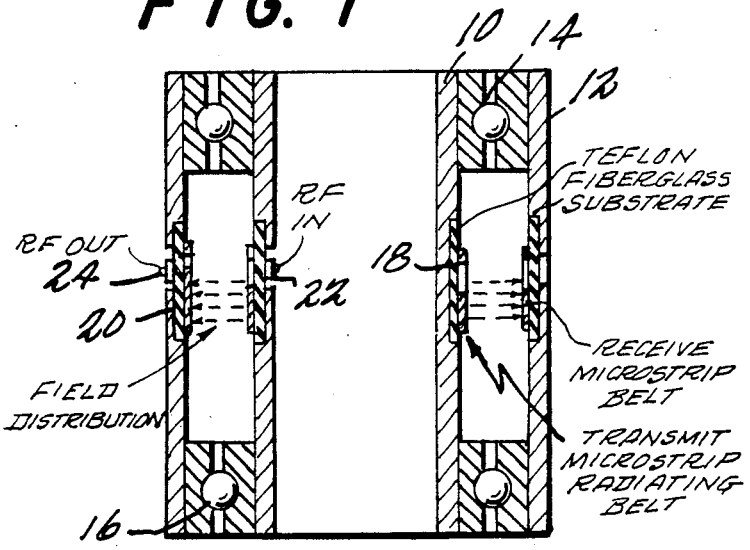
FIG. 4
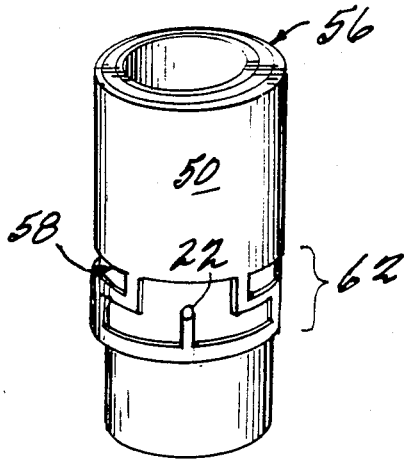
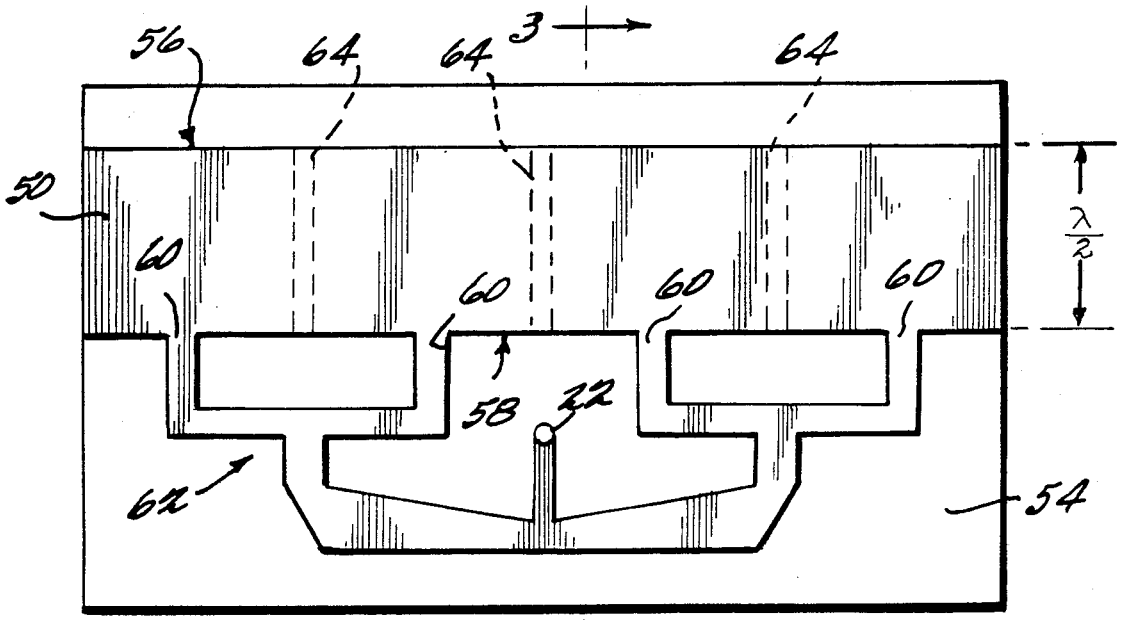
FIG. 2
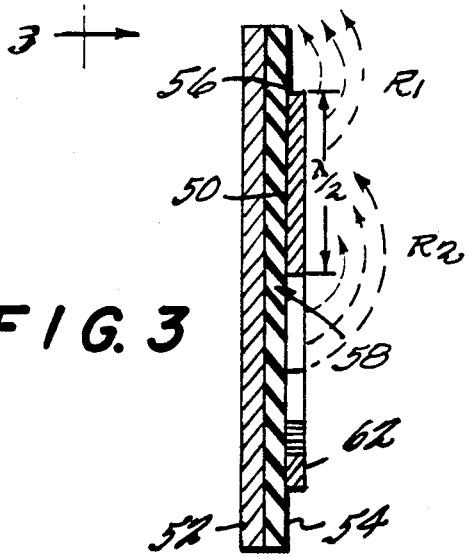
FIG. 3

APPARATUS AND METHOD FOR COUPLING R.F. ENERGY THROUGH A MECHANICALLY ROTATABLE JOINT

This invention is generally directed to method and apparatus for coupling r.f. energy through a mechanically rotatable joint.

This application is related to our copending commonly assigned application Ser. No. 417,517, filed Sept. 13, 1982 which describes a relatively rotatable pair of microwave transition horns for coupling microwave r.f. energy across a rotatable joint. This application is also related to commonly assigned U.S. Pat. No. 3,713,162—Munson et al (1973), U.S. Pat. No. 3,810,183—Krutsinger et al (1974) and its reissue U.S. Pat. No. 29,296—Krutsinger et al (1977) which teach as one of their exemplary embodiments cyclindrically formed microstrip antenna structures suitable for use in this invention.

The provision of rotary joints for conducting r.f. signals represents a relatively old problem for which there have been many prior proposed solutions. For example:

U.S. Pat. No. 2,401,572—Korman (1947)
U.S. Pat. No. 2,426,226—Labin et al (1947)
U.S. Pat. No. 3,786,376—Munson et al (1974)
U.S. Pat. No. 3,914,715—Hubing et al (1975)
U.S. Pat. No. 4,163,961—Woodward (1979)
U.S. Pat. No. 4,233,580—Treczka et al (1980)
U.S. Pat. No. 4,253,101—Parr (1981)
U.S. Pat. No. 4,258,365—Hockham et al (1981)

Korman teaches a type of capacitive coupling through a rotating joint for a parallel wire transmission line. Labin et al and Munson et al teach rotary coaxial cable couplers. Hubing et al achieve rotary coupling by a type of split coaxial ring structure. Woodward provides a rotary waveguide joint and Treczka et al teach a rotary coupler of a non-contact type having a rotary and a stationary resonant space which are ohmically coupled. Parr and Hockham et al are directed to similar disclosures of a rotary annular antenna feed coupler which appears to employ mated continuous rotating loops of "strip line" oriented in the axial dimension.

Microstrip antenna structures per se are also well known in the art. For example, the earlier referenced related commonly assigned already issued U.S. patents describe various types of microstrip antennas. In general, as used to describe this invention, the term "microstrip antenna" will refer to an antenna structure comprising an r.f. radiation "patch" very closely spaced (e.g., much less than one-fourth wavelength at the intended operating frequency) from an underlying electrical reference or ground surface and defining a resonant electrical cavity therebetween with a radiating aperture also being defined between at least one edge of the "patch" and the underlying electrical reference surface. Typically, such microstrip antenna structures are formed by selectively etching away portions of the metal from one side of a dielectric sheet metallically cladded on both sides. One metallic side then becomes the electrical reference surface while the other metallic side is selectively etched away so as to form the radiator "patch" and, in many instances, an integrally formed and connected microstrip feedline structure.

Of course the mere coupling of r.f. energy from one microstrip antenna structure to another is per se known in the art. The mere coupling of r.f. energy from one microstrip transmission line structure to another is also well known in the art as illustrated, for example, by the following prior U.S. patents:

U.S. Pat. No. 3,771,075—Phelan (1973)
U.S. Pat. No. 4,150,345—Goldman et al (1979)
U.S. Pat. No. 4,157,516—Vandegrijp (1979)
U.S. Pat. No. 4,288,759—Stover (198)

None of this latter cited group actually relate to r.f. transmissive rotary joints and the rotary joints proposed in the earlier group of citations are believed to be unduly complex, unreliable and/or inefficient when compared to probable future required optimum performance characteristics. For example, future satellite systems may make it necessary to reliably transfer large quantities of data across a rotary joint without the use of mechanical brushes or other mechanically contacting surfaces to effect the transfer. Many existing practical approaches to this problem use rotating electrical contacts across the joint with some resultant frictional wear and tear that is undesirable both electrically and mechanically, especially at microwave frequencies.

The present invention is believed to provide a unique improved rotary coupling of r.f. energy (including the microwave range of frequencies) without the use of contacting surfaces (thus eliminating the need for any lubrication between such surfaces). At the same time, the center of the rotating structure is not occupied by r.f. signal conveyances. Such an open center design may also provide many advantages for certain applications where it is necessary to provide other mechanical/electrical/material interfaces across the rotary joint. This reliable and efficient transfer of microwave signals across a rotatable joint having an open center is of such a design that it also permits the "stacking" of similar annular r.f. transfer zones such that plural signal channels can be transferred across one rotary joint.

The presently preferred exemplary embodiment of this invention includes first and second annular r.f. radiating structures mechanically connected for concentric relative rotational motion. The "inside" annular radiating structure has a radiation pattern directed outwardly while the "outside" annular radiating structure has a radiation pattern directed inwardly. In the preferred embodiment, such concentric annular radiating structures are realized by two resonant belt-type microstrip antennas placed on the surfaces of concentric cylinders which are connected by bearing surfaces which permit relative rotation therebetween. The r.f. signal is transferred from the interior cylinder antenna to the exterior one or vice versa through the radiation fields (usually the "near" field as opposed to the "far" field) of the microstrip antennas. A nearly uniform amplitude and phase distribution of r.f. field can be obtained around the microstrip belt by ensuring that there is at least one feedpoint for each wavelength of circumferential dimension. Of course, if the total circumference is less than one wavelength, plural feedpoints would not be required. Typically, plural feedpoints of uniform amplitude and phase distribution are achieved by a corporate-structured microstrip feedline that is integrally formed and connected with the belt-type resonant radiating "patch" of the microstrip antenna structures.

In one form of the exemplary embodiment, the annular radiating structure is formed by the annular radiating apertures between the outer edges of an electrically conductive cylindrical belt and the underlying cylindrical reference or ground surface. The axial dimension of such a belt in this instance is substantially equal to one-half wavelength in the resonant cavity included between these conductive surfaces (or integer multiples thereof). In another form of the exemplary embodiment, the annular radiating structure is formed by the annular radiating slot between one edge of an electrically conductive cylindrical belt and the underlying cylindrical reference surface. In this instance, the axial dimension of the belt is approxmiately equal to one-fourth wavelength in the resonant cavity and the other edge of the belt is electrically shorted to the reference surface. In either case, the belt may be substantially continuous about its circumference or it may be broken into plural segments (each with its own feed connection in this instance). If the total circumference dimension is greater than one wavelength at the intended operating frequency, the preferred embodiment includes a corporate-structured feedline attached to at least one edge of the belt at plural spaced-apart feedpoints (at least one for each wavelength of circumference dimension) so as to achieve a substantially uniform distribution of r.f. field amplitudes and phases about the circumference of the belt.

Although the presently preferred exemplary embodiment employs identical one-half wavelength resonant "patches" for both the inner and outer annular radiating structures, it should be appreciated that the inner structures and outer structures do not have to be identical. That is, it may be possible to use any one of the various exemplary embodiments herein described for the inner radiating structure with any other one of the various exemplary embodiments herein described for the outer radiating structure or vice versa.

As should now be apparent, the r.f. coupling across this rotary joint occurs in the annular space between concentric relatively rotatable structures. The radial distance across this annular space is not believed to be critical. One prototype model has been successfully operated with such radial distance being on the order of one-fourth wavelength. It is believed that much longer radial distances (and perhaps even shorter distances) could be successfully utilized for this invention. However, for most applications, it will probably be desirable to minimize such radial dimensions. As presently envisioned, most applications of this invention will probably use the extreme "near" field of the radiating structures for the r.f. coupling rather than the "far" field. Accordingly, most embodiments of this invention will probably involve very closely coupled, high-Q, narrow bandwidth systems. A plurality of such systems can easily be arrayed or "stacked" along the axial dimension of the concentrically rotating cylindrical structures so as to provide simultaneous coupling for plural signal channels across one rotary joint. Conventional r.f. absorption materials (e.g., carbon-loaded, etc.) may be employed to minimize stray radiation through bearing structures or with adjacent annular r.f. radiating structures operating on different frequency channels.

In operation, the exemplary embodiment of this invention transmits r.f. energy from at least one circumferentially extending radiating slot in a resonant cylindrically conformed microstrip antenna structure and receives that transmitted r.f. energy via at least one circumferentially extending radiating slot in a second resonant cylindrical microstrip antenna structure. These antenna structures are substantially concentric and such transmission and reception is normally performed while at least one of the antenna structures is rotated relative to the other. The transmission and reception steps may either or both be performed using two annular radiating slots which may be either substantially continuous about the circumference of the cylindrical structures or discontinuous with periodic gaps between separate annular segments. Preferably, both the transmission and reception functions are performed by feeding r.f. energy to/from plural spaced-apart points along at least one edge of a microstrip antenna structure where the total circumferential dimensions are greater than one wavelength at the intended operating frequency so as to obtain substantially uniform r.f. field amplitudes and phases about the circmference of the antenna structures.

Thus, the present invention provides a relatively simple design which should be both easy to manufacture and reliable in operation. In the exemplary embodiment, r.f. signals are coupled across the annular space between two relatively rotating concentric cylinders via a transmit microstrip antenna conformed to one of the structures and a received microstrip antenna conformed to the other of the relatively rotating structures. The transmit/receive microstrip structures face one another within the annular cavity between the relatively rotating cylinders. Each of the transmit/receive microstrip antenna structures is a full-fledged resonant microstrip antenna structure. In this mode of operation, the set of relatively rotating concentric and resonant dimensioned microstrip antenna structures comprises a very high-Q transmission circuit for high frequency r.f. signals. Such a circuit is believed to be of relatively high quality providing very small frequency and/or phase dispersion, distortion, etc.

Figure 6:
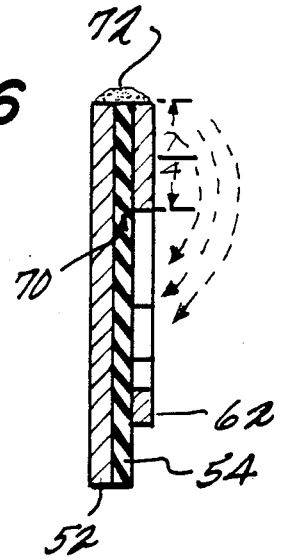
Figure 7:
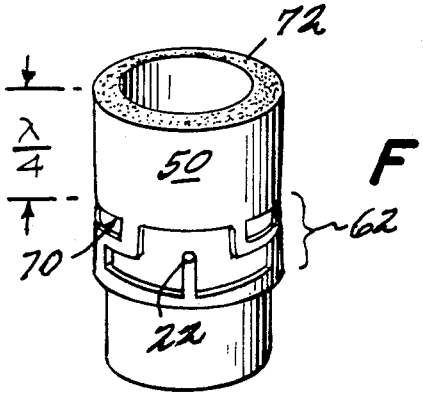

These and other objects and advantages of this invention will be better appreciated by careful study of the following detailed description of the presently preferred exemplary embodiments of this invention taken in conjunction with the accompanying drawings, of which:

FIG. 1 is a cross-sectional view of the presently preferred exemplary embodiment of this invention;

FIGS. 2, 3 and 4 depict the belt-type microstrip antenna and feedline structure which, in its cylindrically conformed configuration, is preferably used for both the inner and outer annular radiating structures in the embodiment of FIG. 1; and FIGS. 5, 6 and 7 depict an alternate form of microstrip belt antenna and feedline structure which may alternately be used to define a single annular radiating slot and which, in its cylindrically conformed configuration, may be utilized for the annular radiating structures of FIG. 1.

In the presently preferred exemplary embodiment depicted in FIG. 1, a first inner cylinder 10 is mounted concentrically with a second outer cylinder 12. The two concentric cylinders 10 and 12 are mounted for relative rotation by conventional bearing structures 14 and 16. A first annular r.f. radiating structure 18 is disposed about the circumference of inner cylinder 10 and has a radiation pattern directed outwardly as depicted in FIG. 1. A second annular r.f. radiating structure 20 is concentrically disposed about the inside of cylinder 12 and has an r.f. radiation pattern directed inwardly. Thus the annular radiating structures 18 and 20 are closely coupled across the annular space between the relatively rotatable cylinders 10 and 12. As shown in FIG. 1, annular antenna structure 18 is fed from a single r.f. connector 22 while antenna structure 20 is fed from a single r.f. connector 24. As will be appreciated, in accordance with the reciprocity theorem, either antenna structure 18 or 20 may be used for transmission and/or reception of r.f. signals.

In the presently preferred exemplary embodiment, each of the antenna structures 18 and 20 defines a pair of annular radiating slots around the opposed edges of a cylindrically conformed conductive "belt" having a resonant axial width dimension of approximately one-half wavelength as measured in the resonant cavity defined between this conductive belt and an underlying electrical reference or ground surface (e.g., the metallic cylinder 10 or 12). As will be appreciated by those in the art, if the antenna structures 18 and 20 are very closedly spaced, there may be some slight capacitive effects which will have to be taken into account so as to make slight adjustments in the dimensions of the belt structure to provide optimum r.f. coupling therebetween. However, for most applications with radial spacing between the antenna structures 18 and 20 being on the order of at least one-fourth wavelength, such capacitive effects should be relatively minimal and perhaps even negligible.

Such a dual slot microstrip antenna structure per se, is already described as one exemplary embodiment in prior commonly assigned U.S. Pat. No. 3,810,183—Krutsinger et al (1974) and its reissued U.S. Pat. No. 29,296—Krutsinger et al (1977). The disclosure of these prior patents is hereby incorporated by reference. FIGS. 2–4 of the present application are directed to this type of annular radiating structure.

The inner radiating structure 18 is actually the one that is depicted in FIGS. 2–4. As should be appreciated, a similar but somewhat longer structure would be analogously conformed in an opposite sense to the inside of cylinder 12 to form the outer antenna structure 20.

As depicted in the "flattened-out" structure shown at FIG. 2, and its cross-section as shown at FIG. 3, a substantially continuous band or belt of conductive material 50 is disposed above an electrical or reference surface 52 by a dielectric sheet 54. The width of the patch or belt 50 (i.e., the axial dimension when cylindrically conformed) is approximately one-half wavelength as measured in the dielectric 54 of the electrically resonant cavity defined between the patch 50 and the underlying electric reference surface 52. Thus, two radiating apertures 56 and 58 are defined between the edges of the patch 50 and the underlying electrical reference surface 52. As should be appreciated, when this structure is cylindrically conformed (as shown in FIG. 4) a pair of radiating apertures 56 and 58 will actually become annular radiating apertures spaced apart axially approximately one-half wavelength and with radiating patterns R1 and R2, respectively, directed to the broadside which, in this instance, would be toward the other antenna structure and vice versa.

If the length of the belt 50 (i.e., the circumferential dimension when cylindrically conformed) is greater than one wavelength at the intended operating frequency, then plural feedpoints 60 are provided along one of its edges such that there is at least one feedpoint for each wavelength of circumferential dimension. If these plural feedpoints are then fed with r.f. energy having substantially uniform amplitude and phase, a substantially uniform r.f. radiating field is provided about the circumference of the relatively rotatable antenna structures. A suitable technique for achieving such plural feedpoints is the corporate-structured microstrip feedline 62 shown in FIG. 2–4. Signals are fed to/from a common feedpoint 22 (e.g., a coaxial connector having a center conductor connected to point 22 and an outer conductor connected through dielectric 54 to the underlying reference surface 52). Such r.f. signals from common feedpoint 22 are equally divided at the first juncture in the corporate structure and similarly equally divided at each subsequent juncture in the corporate structure so as to provided equal amplitude and commonly phased signals to/from the plural feedpoints 60 which are spaced at intervals no greater than approximately one wavelength. With such plural feedpoints, it is also permissible to physically break the belt 50 along dotted lines 64 if desired so as to provide separate annular segments (when cylindrically conformed) instead of a single substantially continuous radiating aperture.

As previously explained, the presently preferred mode of constructing such microstrip antenna radiating structures and their integrally formed and connected corporate-structured feedline is by conventional selective etching of the metal from one surface of a dielectric sheet initially having metallic cladding on both of its sides. Conventional photo-resist and chemical etching techniques, for example, may be employed. The structure may be initially formed in its "flattened-out" configuration as shown at FIGS. 2 and 3 and thereafter cylindrically conformed as shown in FIG. 4. Alternativley, if the starting materials are of a cylindrical shape, the antenna structures may be formed in that cylindrical shape initially. Other construction techniques may also be employed as should be appreciated.

An alternate microstrip belt-type antenna structure is shown at FIGS. 5–7. This structure is substantially similar to one of the exemplary embodiments described in the earlier issued commonly assigned U.S. Pat. No. 3,713,162—Munson et al (1973). It is physically similar to the antenna structure already described with respect to FIGS. 2–4 except that the width of the belt 50 which defines the electrically resonant cavity therebelow is only one-fourth wavelength in dimension and one of the belt edges is electrically shorted to the underlying reference surface thus defining an electrically resonant quarter wavelength cavity and with the opposite edge of the belt defining a single radiating aperture. This single radiating aperture is denoted with reference numeral 70 and the electrical short circuit (e.g., plating, soldering, through pin connections or through-hole-plating connections, etc.) is depicted at 72 in FIGS. 5–7.

Although only a few presently preferred exemplary embodiments have been explicitly described above, those skilled in the art will recognize that there are many possible variations and modifications of these exemplary embodiments which may be made without materially departing from the novel advantages and features of this invention. Accordingly, all such variations and modifications are intended to be included within the scope of the following claims.

What is claimed is:

1. An r.f. rotary joint comprising:

a first cylindrical r.f. radiating structure having its radiation pattern directed outwardly;

a first single r.f. feed point and feed structure fixedly connected to feed r.f. energy to/from said first cylindrical radiating structure of substantially uniform amplitude and phase around its cylindrical circumference;

a second cylindrical r.f. radiating structure disposed concentrically around the first structure and having its radiation pattern directed inwardly;

a second single r.f. feed point and feed structure fixedly connected to feed r.f. energy to/from said second cylindrical radiating structure of substantially uniform amplitude and phase about its cylindrical circumference; and rotary bearing means mounting said first and second structures for relative rotation.

2. An r.f. rotary joint comprising:

a first annular r.f. radiating structure having its radiation pattern directed outwardly;

a second annular r.f. radiating structure disposed concentrically around the first structure and having its radiation pattern directed inwardly;

an underlying cylindrical electrical reference surface disposed substantially less than one-fourth wavelength at the intended r.f. operating frequency from at least one of said first and second structures; and rotary bearing means mounting said first and second structures for relative rotation, wherein said at least one of the first and second structures for relative rotation, wherein said at least one of the first and second structures comprises an electrically conductive cylindrical belt having an axial dimension approximately equal to one-half wavelength at the intended r.f. operating frequency.

3. An r.f. rotary joint as in claim 2 wherein said belt is substantially continuous about its circumference.

4. An r.f. rotary joint as in claim 2 or 3 wherein said at least one structure also comprises a corporate-structured feedline attached to at least one edge of the belt at plural spaced-apart feedpoints so as to achieve a substantially uniform distribution of r.f. field amplitudes and phases about the circumference of the belt.

5. An r.f. rotary joint comprising:

a first annular r.f. radiating structure having its radiation pattern directed outwardly;

a second annular r.f. radiating structure disposed concentrically around the first structure and having its radiation pattern directed inwardly;

an underlying cylindrical electrical reference surface disposed substantially less than one-fourth wavelength at the intended r.f. operating frequency from at least one of said first and second structures; and rotary bearing means mounting said first and second structures for relative rotation, wherein said at least one of the first and second structures comprises an electrically conductive cylindrical belt having an axial dimension approximately equal to one-fourth wavelength at the intended r.f. operating frequency, one circumferentially-extending edge of said belt being electrically shorted to said reference surface.

6. An r.f rotary joint as in claim 5 wherein said belt is substantially continuous about its circumference.

7. An r.f. rotary joint as in claim 5 or 6 wherein said at least one structure also comprises a corporate-structured feedline attached to at least one edge of the belt at a plural spaced-apart feedpoints so as to achieve a substantially uniform distribution of r.f. field amplitudes and phases about the circumference of the belt.

8. An r.f. rotary joint comprising:

a first annular r.f. radiating structure having its radiation pattern directed outwardly;

a second annular r.f. radiating structure disposed concentrically around the first structure and having its radiation pattern directed inwardly;

an underlying cylindrical electrical reference surface disposed substantially less than one-fourth wavelength at the intended r.f. operating frequency from at least one of said first and second structures; and rotary bearing means mounting said first and second structures for relative rotation, wherein both said first and second structures each comprise an electrically conductive cylindrical belt having an axial dimension approximately equal to one-half wavelength at the intended r.f. operating frequency and spaced substantially less than one-fourth wavelength from its respectively associated said underlying cylindrical electrical reference surface.

9. An r.f. rotary joint as in claim 8 wherein said belt is substantially continuous about its circumference.

10. An r.f. rotary joint as in claim 8 wherein said at least one structure also comprises a corporate-structured feedline attached to at least one edge of the belt at plural spaced-apart feedpoints so as to achieve a substantially uniform distribution of r.f. field amplitudes and phases about the circumference of the belt.

11. An r.f. rotary joint comprising:

a first annular r.f. radiating structure having its radiation pattern directed outwardly;

a second annular r.f. radiating structure disposed concentrically around the first structure and having its radiation pattern directed inwardly;

an underlying cylindrical electrical reference surface disposed substantially less than one-fourth wavelength at the intended r.f. operating frequency from at least one of said first and second structures; and rotary bearing means mounting said first and second structures for relative rotation, wherein both said first and second structures each comprise an electrically conductive cylindrical belt having an axial dimension approximately equal to one-fourth wavelength at the intended r.f. operating frequency and spaced substantially less than one-fourth wavelength from its respectively associated said underlying electrical reference surface, one circumferentially-extending edge of said belt being electrically shorted to its respective said reference surface.

12. An r.f. rotary joint as in claim 11 wherein said belt is substantially continuous about its circumference.

13. An r.f. rotary joint as in claim 11 or 12 wherein both said first and second structures each comprise a corporate-structured feedline attached to at least one edge of the belt at plural spaced-apart feedpoints so as to achieve a substantially uniform distribution of r.f. field amplitudes and phases about the circumference of the belt.

14. An r.f. transmissive rotary joint comprising:

an outer cylinder having an inner cylindrical surface;

an inner cylinder having an outer cylindrical surface and mounted for rotational motion within said outer cylinder;

a first microstrip r.f. antenna disposed on said inner cylindrical surface and defining at least one circumferentially extending radiating aperture therearound; and a second microstrip r.f. antenna disposed on said outer cylindrical surface and defining at least one circumferentially extending radiating aperture therearound.

15. An r.f. transmissive rotary joint as in claim 14 wherein at least one of said first and second microstrip r.f. antennas comprises a belt of electrically conductive material having an axial dimension approximately equal to one-half wavelength at the intended r.f. operating frequency and spaced substantially less than one-fourth wavelength from an underlying electrical reference surface associated with its respectively corresponding cylindrical surface.

16. An r.f. transmissive rotary joint as in claim 15 wherein said belt of electrically conductive material is substantially continuous about its circumference.

17. An r.f. transmissive rotary joint as in claim 15 or 16 wherein said at least one of said first and second microstrip antennas also comprises a corporate-structured feedline attached to at least one edge of said belt at plural spaced apart feedpoints so as to achieve a substantially uniform distribution of r.f. field amplitudes and phases about the circumference of the belt.

18. An r.f. transmissive rotary joint as in claim 14 wherein at least one of said first and second microstrip antennas comprises a belt of electrically conductive material having an axial dimension approximately equal to one-fourth wavelength at the intended r.f. operating frequency and spaced substantially less than one-fourth wavelength from an underlying electrical reference surface associated with its respectively corresponding cylindrical surface, one circumferentially extending edge of said belt being electrically shorted to said reference surface.

19. An r.f. transmissive rotary joint as in claim 18 wherein said belt of electrically conductive material is substantially continuous about its circumference.

20. An r.f. transmissive rotary joint as in claim 18 or 19 wherein said at least one of said first and second microstrip antennas also comprises a corporate-structured feedline attached to at least one edge of said belt at plural spaced apart feedpoints so as to achieve a substantially uniform distribution of r.f. field amplitudes and phases about the circumference of the belt.

21. An r.f. transmissive rotary joint as in claim 14 wherein both said first and second microstrip antennas each comprise a belt of electrically conductive material having an axial dimension approximately equal to one-half wavelength at the intended r.f. operating frequency and spaced substantially less than one-fourth wavelength from an underlying electrical reference surface associated with its respectively corresponding cylindrical surface.

22. An r.f. transmissive rotary joint as in claim 21 wherein said belt of electrically conductive material is substantially continuous about its circumference.

23. An r.f. transmissive rotary joint as in claim 18 or 19 wherein each of said antennas also comprises: a corporate-structured feedline attached to at least one edge of the belt at plural spaced-apart feedpoints so as to achieve a substantially uniform distribution of r.f. field amplitudes and phases about the circumference of the belt.

24. An r.f. transmissive rotary joint as in claim 14 wherein both said first and second microstrip antennas each comprise a belt of electrically conductive material having an axial dimension approximately equal to one-fourth wavelength at the intended r.f. operating frequency and spaced substantially less than one-fourth wavelength from an underlying electrical reference surface associated with its respectively corresponding cylindrical surface, one circumferentially extending edge of said belt being electrically shorted to said reference surface.

25. An r.f. transmissive rotary joint as in claim 24 wherein said belt of electrically conductive material is substantially continuous about its circumference.

26. An r.f. transmissive rotary joint as in claim 24 or 25 wherein each of said antennas also comprises said at least one of said first and second microstrip antennas also comprises a corporate-structured feedline attached to at least one edge of said belt at plural spaced apart feedpoints so as to achieve a substantially uniform distribution of r.f. field amplitudes and phases about the circumference of the belt.

27. A method for transmitting r.f. energy across a rotatable joint, said method comprising the steps of:

transmitting r.f. energy from at least one circumferentially-extending radiating slot in a first resonant cylindrical microstrip antenna structure;

receiving said transmitted r.f. energy via at least one circumferentially-extending radiating slot in a second resonant cylindrical microstrip antenna structure which is substantially concentric with said first cylindrical microstrip antenna structure; and performing said transmitting and receiving steps while at least one of said first and second cylindrical microstrip structures is rotated relative to the other.

28. A method as in claim 27 wherein said transmitting and receiving steps comprise feeding r.f. energy to/-from plural spaced-apart points along at least one edge of the first and second microstrip antenna structures respectively so as to obtain substantially uniform r.f. field amplitudes and phases about the circumferential microstrip antenna structures.

29. A method as in claim 27 or 28 wherein said transmitting and receiving steps are performed using annular radiating slots which extend substantially continuously about the circumference of each antenna structure.

30. A method as in claim 29 wherein said transmitting and receiving steps are each performed using two annular radiating slots.

31. A method as in claim 27 or 28 wherein said transmitting and receiving steps are each performed using two annular radiating slots.

* * * * *